US007234509B2

(12) United States Patent
Poloni et al.

(10) Patent No.: US 7,234,509 B2
(45) Date of Patent: Jun. 26, 2007

(54) METALLIC BATH CONTAINMENT DEVICE BETWEEN THE CRYSTALLIZING ROLLERS OF A CONTINUOUS CASTING MACHINE

(75) Inventors: Alfredo Poloni, Fogliano Redipuglia (IT); Andrea De Luca, Remanzacco (IT); Nuredin Kapaj, Udine (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/526,317

(22) PCT Filed: Aug. 26, 2003

(86) PCT No.: PCT/EP03/09436

§ 371 (c)(1),
(2), (4) Date: Feb. 24, 2005

(87) PCT Pub. No.: WO2004/020127

PCT Pub. Date: Mar. 11, 2004

(65) Prior Publication Data

US 2006/0102312 A1 May 18, 2006

(30) Foreign Application Priority Data

Aug. 27, 2002 (IT) ..... MI2002A1853

(51) Int. Cl.
*B22D 11/06* (2006.01)

(52) U.S. Cl. ..... 164/428; 164/480

(58) Field of Classification Search ..... 164/428, 164/480

See application file for complete search history.

(56) References Cited

U.S. PATENT DOCUMENTS

| | | | | |
|---|---|---|---|---|
| 5,915,454 | A | 6/1999 | Wright et al. | |
| 6,032,722 | A * | 3/2000 | Russell et al. | 164/428 |
| 6,655,447 | B1 * | 12/2003 | Marti et al. | 164/428 |
| 6,892,793 | B2 * | 5/2005 | Liu et al. | 164/448 |

FOREIGN PATENT DOCUMENTS

| | | |
|---|---|---|
| GB | 2296883 | 7/1996 |
| GB | 2337016 | 11/1999 |

* cited by examiner

*Primary Examiner*—Kuang Y. Lin
(74) *Attorney, Agent, or Firm*—Sampson & Associates, P.C

(57) ABSTRACT

A molten metal containment device between the crystallizing rollers (38, 39) of a continuous casting machine comprises a lateral containment plate (47) able to press against the shoulder surfaces (40, 41) of the crystallizing rollers (38, 39); means of providing pressure (37) able to move said lateral containment plate (47) so as to move it close to and press it against said shoulder surfaces (40, 41). The lateral containment plate (47) is fixed to the means of providing pressure (37) through an articulated joint which comprises a flexible tubular sleeve (1), corrugated like bellows and able to support said lateral containment plate (47) allowing the horizontal pivoting at least around one axis of pivoting (X) horizontal and not parallel to the axes of rotation (A1, A2) of the rollers (38, 39). In a second aspect of the invention the containment plate (47) is fixed to the means of providing pressure (37) through more supports (20).

13 Claims, 7 Drawing Sheets

METALLIC BATH CONTAINMENT DEVICE BETWEEN THE CRYSTALLIZING ROLLERS OF A CONTINUOUS CASTING MACHINE

FIELD OF THE INVENTION

This application claims priority to PCT/EP2003/009436 entitled Metallic Bath Containment Device between the Crystallising Rollers of a Continuous Casting Machine, filed on 26 Aug. 2003, which claims Priority to Italian Patent Application No. MI2002A001853, filed on 27 Aug. 2002.

The invention relates to system of lateral confinement for liquid metal between the crystallising rollers of a continuous casting machine of strips or other metallic products.

The invention refers in particular to a connection system between the pressure providing unit and the liquid bath confinement plates which guarantee the most uniform distribution possible on the surfaces of said plates in frictional contact with said rollers and which allow good fitting of said plates with respect to the lateral surfaces of said rollers under all working conditions.

PRIOR ART

Devices to contain the molten metal at the sides of the crystallising rollers of continuous casting machines of steel strips and other metallic products are known in the art.

In particular, solutions which adopt oscillating connections which allow the plates to auto-align with the edges of the casting rollers are known. More specifically, the patent GB 2,296,883 envisages pivoting elements, not better specified, placed with respect to the line of action of the pushing force, exercised on the liquid bath, so that the action of said force tends to make rotate the plates towards the lower parts of the cylinders.

The use of such a solution allows to meet the requested auto-alignment of the plates with respect to the rollers but can result in operative difficulties in some circumstances. In fact, since the plates are free to rotate in their plane, the plates themselves expose different areas of contact on the ends of the rollers and, if the plates are already worn, can present worm shoulders above the contact with the new exposed faces thus resulting in poor closing contact, misalignment of the lateral barrier and the loss of molten metal from the casting bath.

The patent GB 2,337,016 overcomes the above mentioned problem of rotation: in fact the plate can freely oscillate, thanks to the pivots, both longitudinally and laterally with respect to the rollers, but the rotation of the plate on Its own plane is limited.

According to such a solution however the cooling and the lubrication of the pivot can be difficult to achieve. A problem at the heart of the present invention is to supply a molten metal containment device between the crystallising rollers of a continuous casting plant for steel or other metals, which allows the horizontal pivoting of the liquid bath confinement plates present and simplifying the cooling and lubrication of the articulated joint which allows such horizontal pivoting.

According to a first aspect of the present invention, such a problem is solved by means of a containment device for containment of melt between crystallising rollers of a casting machine, wherein the crystallising rollers are able to rotate around two substantially horizontal rotation axes, and are placed in positions such as to define between them a zone of minimal distance between the surfaces of the crystallising rollers and so to allow, in the space above said zone of minimal distance, the accumulation of a melt poured from a tundish or other means of distribution, each of crystallising rollers comprising one or more shoulder surfaces lying in a plane normal to the rotation axes of the crystallising rollers, the containment device comprising, on each side of the crystallising rollers

- a lateral containment plate able to fit tightly against at least part of each of the shoulder surfaces, whereby it contains the melt;
- pressing means able to move the lateral containment plate so as to bring it close to and hold it tightly against the shoulder surfaces and/or remove the lateral containment plate from the shoulder surfaces;
- wherein the lateral containment plate is fixed to the pressing means through an articulated joint,
- characterised by the fact that the articulated joint comprises flexible connecting element able to sustain the lateral containment plate allowing a horizontal pivoting at least around a pivot axis horizontally and substantially normal to the rotation axes.

Preferably the flexible connecting element comprises a flexible tubular sleeve, the walls of which can be corrugated like a bellows: that allows the cooling of the articulated joint from inside, for example by a flow of water or other cooling fluid, with little difficulty with respect to the state of the art articulated joint.

According to a particular embodiment, the force which the containment plates exercise against the crystallising rollers is controlled by controlling the pressure of the cooling water inside the articulated joint: this solution allows a more fine and precise regulation of the force applied to the containment plates.

According to such a solution, the pivot which allows the horizontal pivoting of the liquid metal bath containment plate no longer being necessary, the cooling of the various supports is simplified. Other innovative aspects of the present invention are expressed in the secondary claims.

Further advantages deliverable with the present invention will be more evident, to the export in the field, from the following detailed description of an example of a particular embodiment non limiting in character, with reference to the following figures, of which:

DETAILED DESCRIPTION

Figure 1:
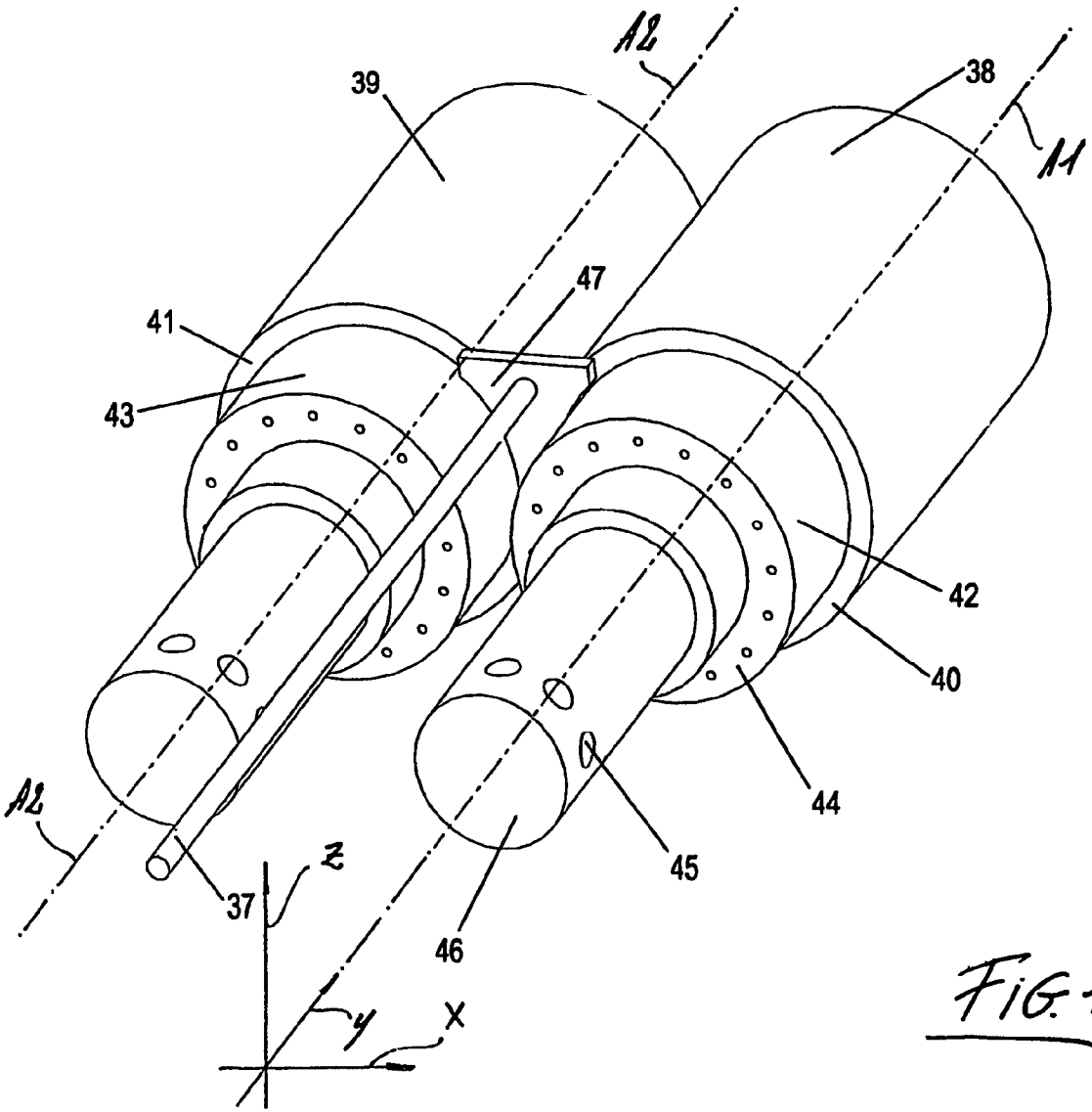
FIG. 1 shows schematically a three dimensional view of the crystallising rollers and of the lateral containment plates of a continuous casting plant.
Figure 2:
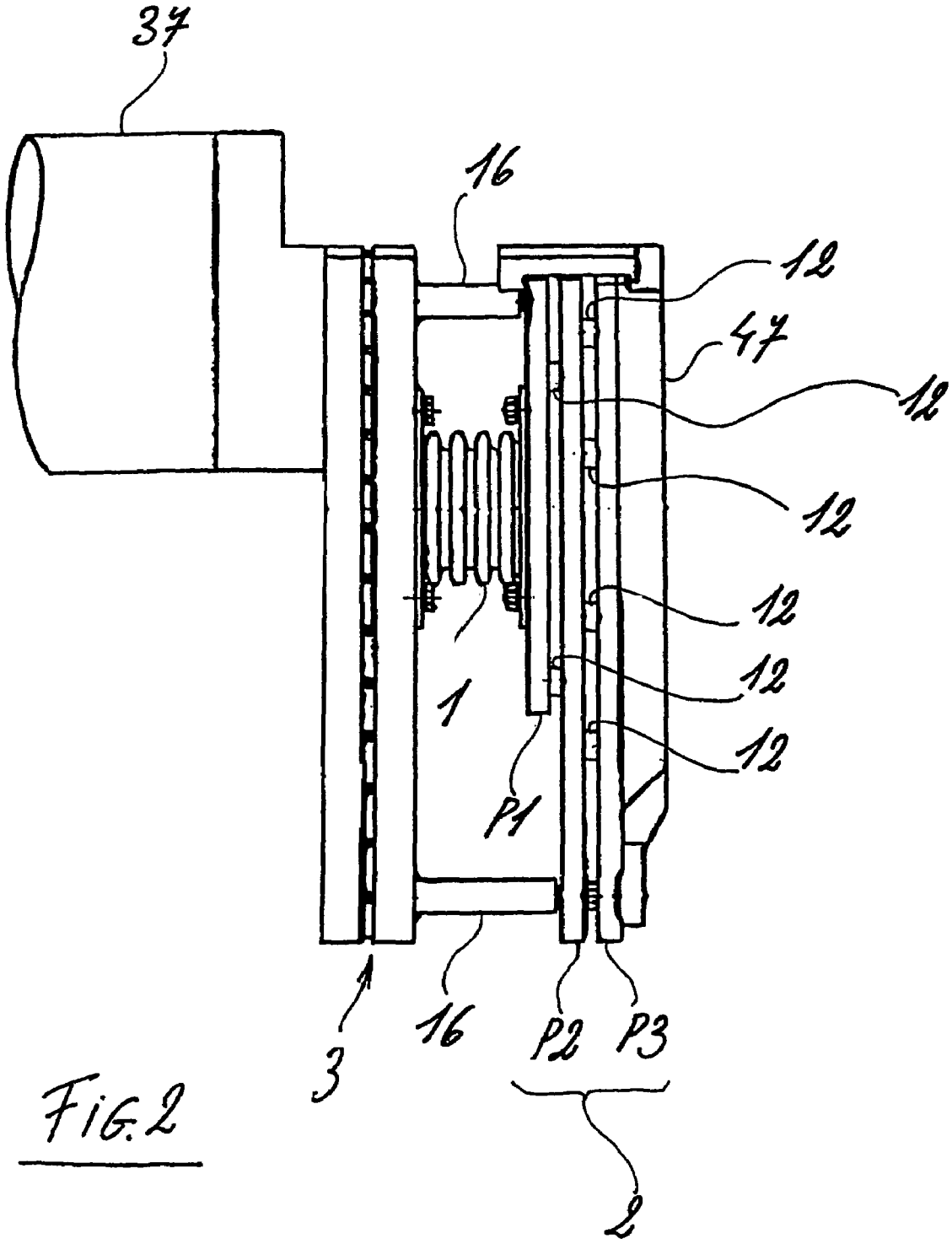
FIG. 2 shows schematically a lateral view of a first particular embodiment of a containment device according to the present invention.

FIG. 1 shows a pair of crystallising rollers 38, 39 of a continuous casting plant (continuous casting), for example of steel. As is noted, the crystallising rollers 38, 39 can rotate around the axis A1, A2 more or less parallel to each other and placed at such a distance apart, one from the other, that the crystallising rollers 38, 39 at their point of minimal distance (normally referred to as the "kissing point" 50—FIG. 3) defines an elongated slot of appropriate width to allow the formation of a strip or of another steel product by continuous casting. The molten metal cast from above the elongated slot, for example from a tundish or from other analogous means of distribution and feeding molten metal, forms an accumulation of liquid metal herein afterwards called molten metal bath.

Still with reference to the example of FIG. 1, the shaft 46 of the crystallising rollers 38, 39 has radial holes 45 for the adduction of cooling water which, through the internal passages not shown, is carried up to the flange 44 and from there distributed circumferentially on the periphery of said rollers through appropriate channels which extend through their interior parallel to the axes. The tracts 42, 43 of the cylinders 38, 39 do not interfere with the formation of the strip in that they are not bathed in the liquid steel; the shoulders 40, 41 mark the beginning of the area of contact with the liquid steel and the lateral confinement of said steel inside said area is guaranteed by a pair of containment plates 47, located at both sides of the crystallising rollers 38, 39. Needing to come into direct contact with the liquid bath and avoid the solidification of the molten metal, the containment plates 47 are generally made of refractory material; Their transversal dimensions, and therefore their surface extension, is limited by the shape of the crystallising rollers 38, 39 and depends on the height of the shoulders 40, 41.

Figure 3:
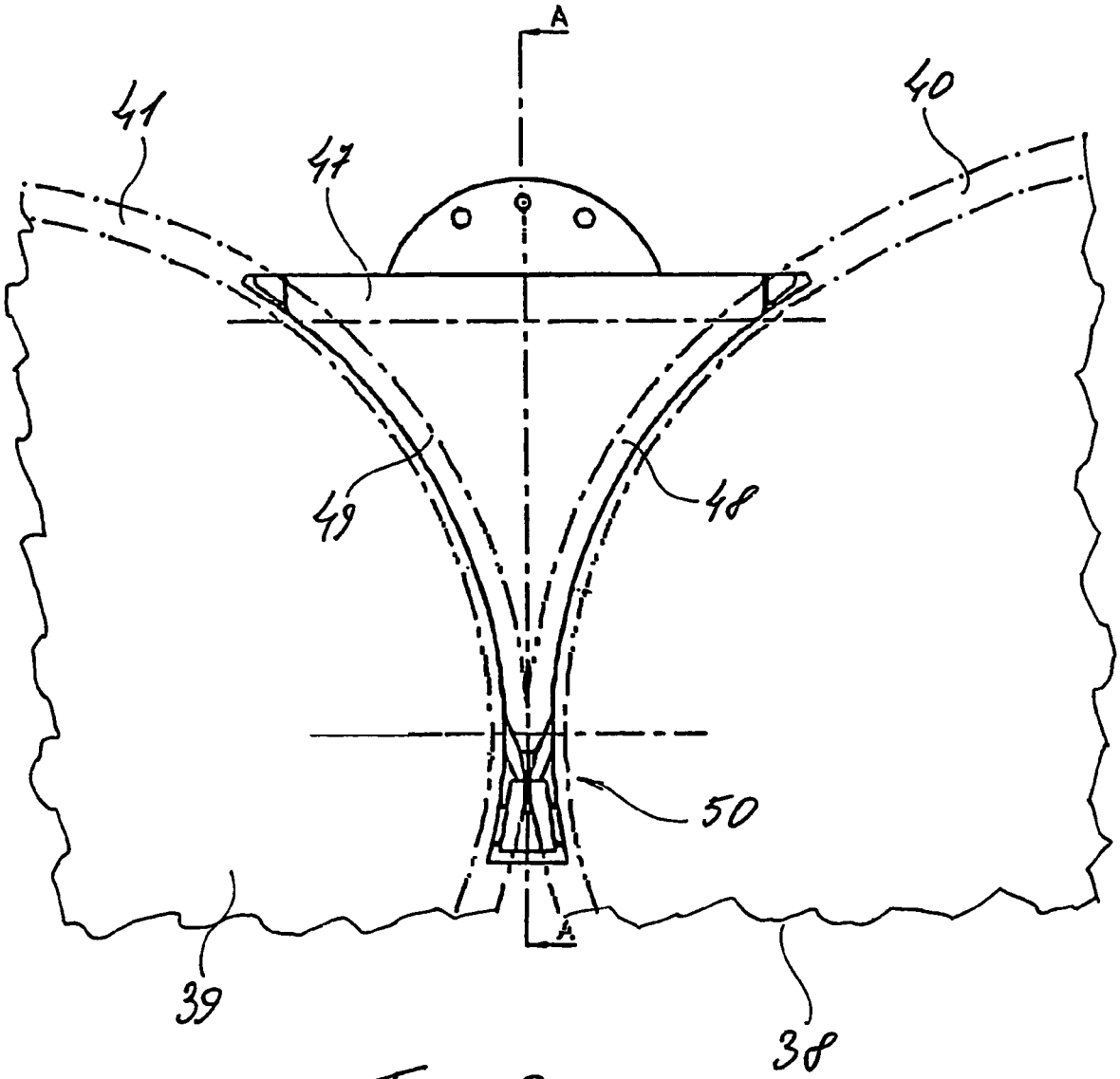
FIG. 3 shows schematically a frontal view of the device of FIG. 2.

FIG. 3 highlights the areas 48, 49 of the plate 47 which are in frictional contact with the respective shoulders 40, 41 of the crystallising rollers 38, 39 and the point 50 of minimal distance between the rollers called the "kissing point". Each plate 47 is fixed to a command shaft 37 and by it moved along a route almost parallel to the axes of rotation A1, A2 of the crystallising rollers 38, 39 so as to be approaching to shoulder surfaces 40, 41, in the operative position, or withdrawn from them to carry out for example maintenance operations of the crystallising rollers 38, 39, the substitution of the rollers themselves or the substitution of the plates.

The command shaft 37 is acted upon by appropriate means of acting, such as for example a hydraulic cylinder, not represented.

In the example embodiment illustrated in FIGS. 2–5, the containment plate 47 of refractory material is fixed to a first support indicated collectively with the reference 2; at the end of the command shaft 37 is fixed a second support 3—realisable in a known manner—and the first support 2 and the second support 3 are connected to each other by means of an articulated joint 4.

Still with the example shown in FIGS. 2–5, the first support 2 comprises a first steel plate P3, onto which is fixed the plate of refractory material 47 and which plate P3 is joined, by means of a plurality of fixing elements 12—for example screws, welded pivots or still others—to a second steel plate P2; analogously, the second connecting plate P2 is connected, by means of another plurality of fixing elements 12 to a third steel plate P1.

The system of plates P1–P3 and of fixing elements 12 is described in more detail in the pending European patent application No. 01120627.3 by the same applicant and is herein described as making part of a preferential and non limiting embodiment of a containment device according to the present invention, but is not an indispensable element for the realisation of the present invention and, without leaving the ambit of the present finding invention, can also be realised in different manners.

Figure 4:
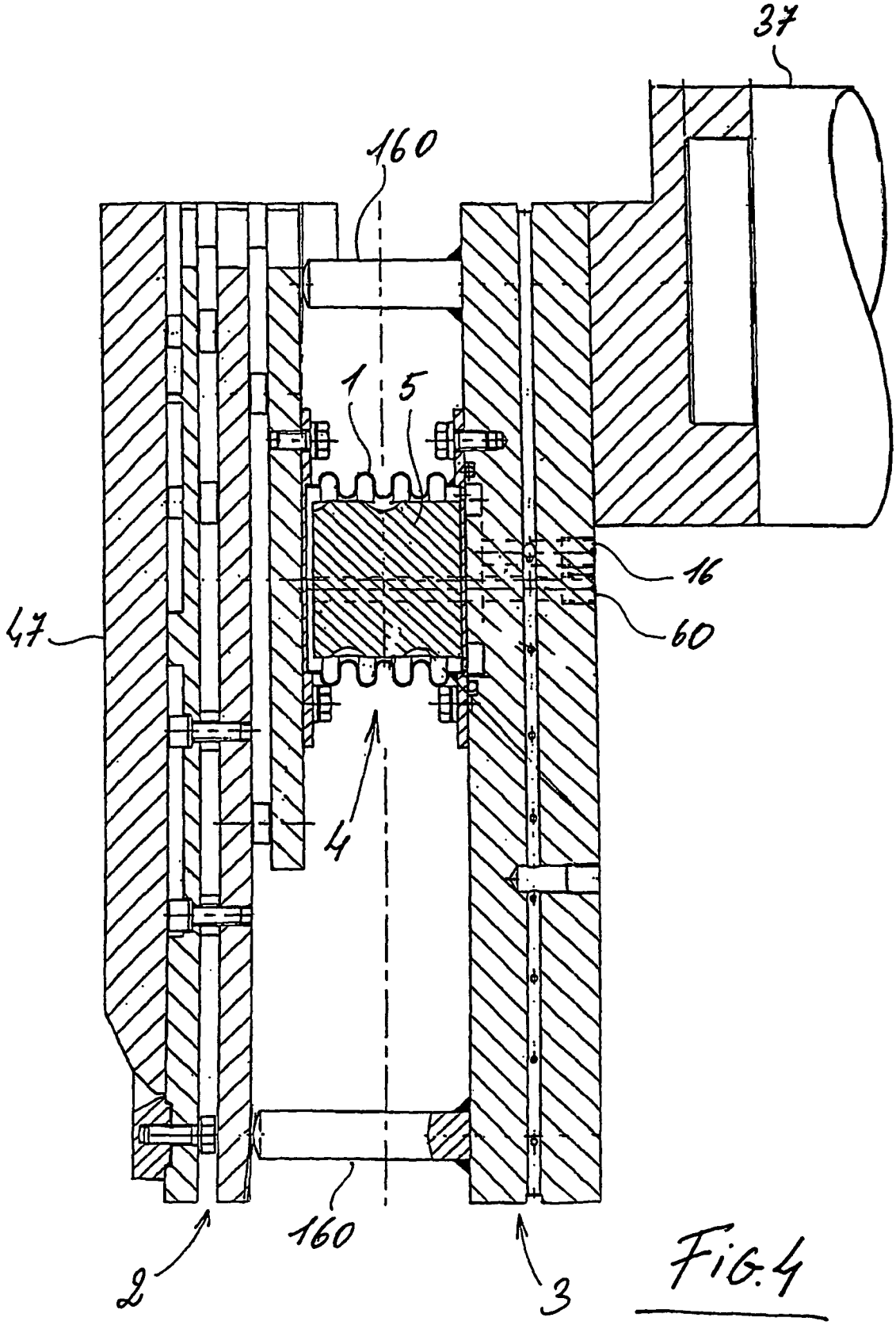
FIG. 4 shows schematically a lateral view in section of the device of FIG. 2.
Figure 5:
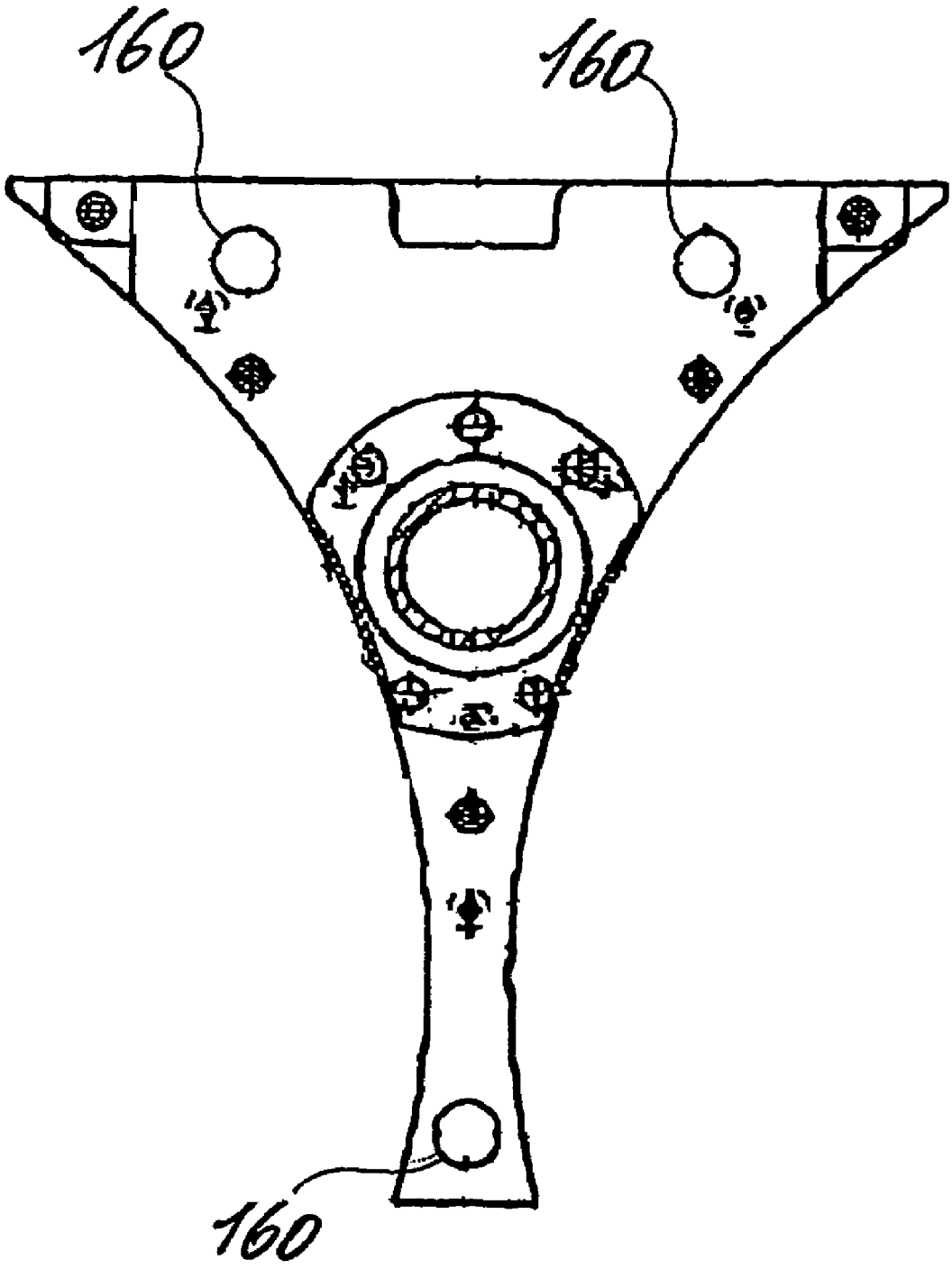
FIG. 5 shows schematically a front view in section of the device of FIG. 1.

According to a first aspect of the present invention, the articulated joint 4 comprises a flexible connecting element 1, able to bind and support the steel plate P1 and through it the containment plate 47; in the example embodiment of FIGS. 4–5 such a flexible connecting element 1 comprises a tubular sleeve 1 of appropriate flexibility and shape, dimensions and rigidity such as to allow the horizontal pivoting of the containment plate 47 at least around one of the axes of pivoting X horizontal and with substantially non parallel orientation to each of the axes of rotation of the crystallising rollers 38, 39; in the preferred example embodiment of FIG. 1–5, the tubular sleeve 1 allows the containment plates 47 to oscillate around at least one axis X horizontal and almost normal to the axis of rotation A1, A2 of the crystallising rollers 38, 39—with reference to the FIG. 1, the axis Y is horizontal and parallel to the axes of rotation A1 and A2 of the crystallising rollers 38, 39, the axis X is horizontal and normal to the axis Y, the axis Z is vertical and normal to the axes X and Y.

The tubular sleeve 1 in addition has preferably a rigidity such as to allow it to support the weight of the first support 2 and of the containment plate 47 flexing like a cantilever shelf, with an appropriately limited angle of inflection.

Preferably the walls of the tubular sleeve 1 have substantially undulating shape like a bellows and the sleeve 1 is cooled, with an appropriate cooling fluid which runs inside of it, and inside the sleeve 1 is housed an internal body -or buffer- 5 realised for example as a stout body able to fill the internal cavity of the tubular sleeve 1, leaving an appropriate perimeter clearance between the lateral surfaces of the buffer 5 and the interior walls of the tubular sleeve 1.

Figure 4A:
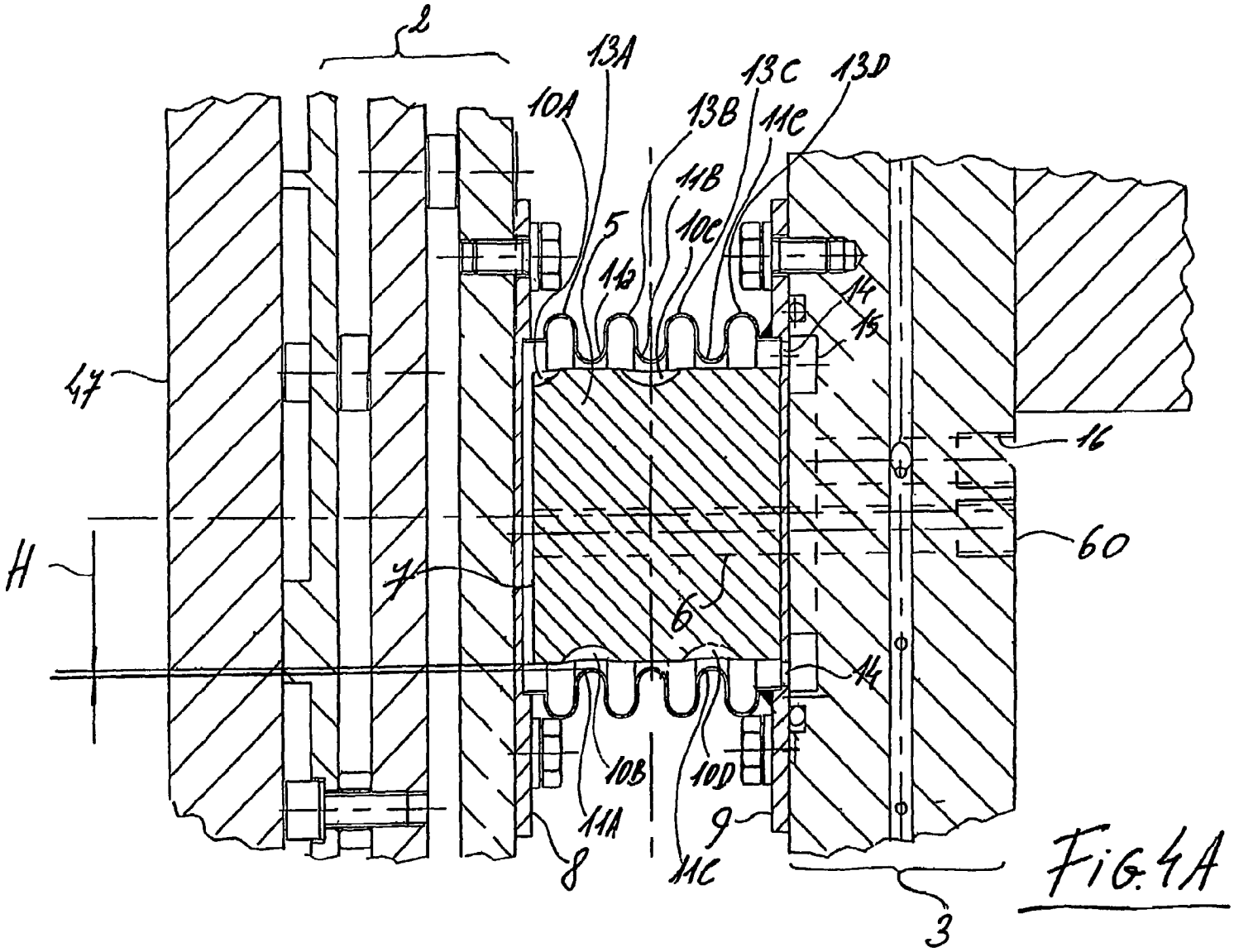
FIG. 4A shows schematically an enlarged detail of the view of FIG. 4.

In the example illustrated in FIGS. 4, 4A the buffer 5 is realised as an approximately cylindrical solid body, of an appropriate material, metallic for example; inside the buffer 5 is hollowed a through hole 6 connected to the supply 60 of a cooling circuit—for example a circuit of water, aqueous mixture or other thermo-convecting fluid. The through hole 6 opens on the flat end 7 of the buffer 5 to the side of the first support 2; The tubular sleeve 1 is closet to the end of the two plates -or flange- 8, 9, by means of which is fixed onto the plate P2 and onto a plate of the first support 2; The flat end 7 of the buffer and the internal surfaces of the flanges 8 are separated so as to define a meatus for the passage of cooling fluid which originates from the through hole 6.

In FIG. 4A the references 13*a*, 13*b*, 13*c*, 13*d* indicate the ribbing—called also area of ribbing or nervature—of the bellows—that is the parts with the greatest diameter—of the bellows 1, whilst the references 11*a*, 11*b*, 11*c*, 11*d* indicate the grooves of the bellows, that is the areas of the bellows with the smallest diameters; in the example embodiment of FIG. 4A the nervature 13*a*–13*d* have the shape of raised rings closet on themselves and located almost parallel to each other.

Preferably the rigidity, the shape and the sizes of the tubular sleeve 1, let alone the shape and dimensions of the buffer 5 are selected such that the tubular sleeve 1, deforming and flexing like a cantilever shelf under the weight of the first support 2 and the containment plate 47, or oscillating to adapt itself to the geometric imperfections of the shoulder surfaces 40, 41 of the crystallising rollers, does not come into contact with nor rest on the buffer 5: that is assisted by the fact that the oscillations, that the containment plate 47 must perform to adapt itself to the geometric irregularities that the surfaces 41 assume in use as a cause of the wear and the other factors, are limited to only a few degrees.

To that end the perimeter clearance between the lateral surfaces of the buffer 5 and the inside of the walls of the tubular sleeve bellows 1 is variable along the axis of the cylindrical buffer 5, but with reference to the shape of the undeformed tubular sleeve 1, i.e. not subjected to the weight of the containment plate 47 and its support 2- never less than a minimal distance H- FIG. 4A.

Figure 4C:
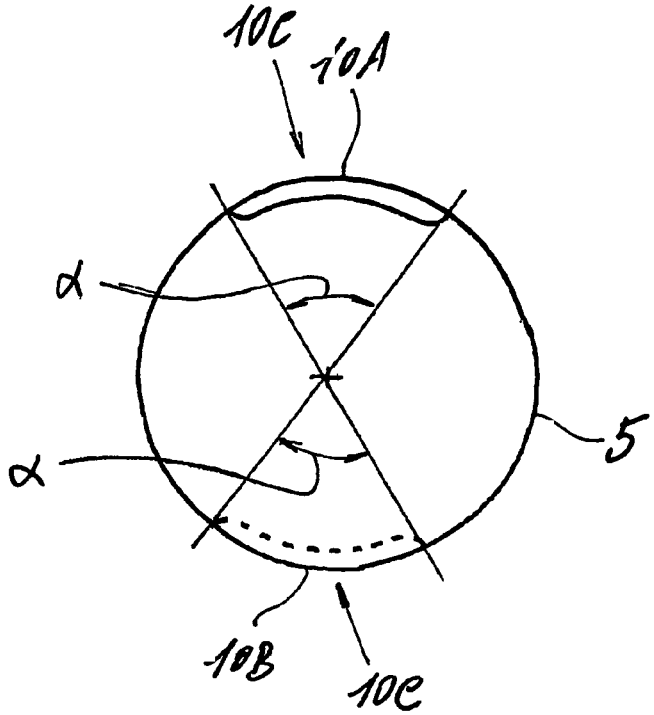
FIG. 4C shows schematically a front view of the buffer of the device of FIG. 2.

Advantageously, on the lateral surfaces of the buffer 5 are excavated a plurality of notched areas 10 which, in the example of FIG. 4A have the shape of sectors of circular grooves placed oblong in correspondence with some trough areas 11 of the undulations of the bellow of the tubular sleeve 1; in the example described the notched areas 10 have an angular opening α of approx. 30° with respect to the central axis of symmetry of the almost cylindrical buffer 5 (FIG. 4C), and in addition—preferably but not necessarily—have almost parallel orientation to the undulations of the bellows of the tubular sleeve 1, or normal to the axis of the cylindrical buffer 5.

Figure 4B:
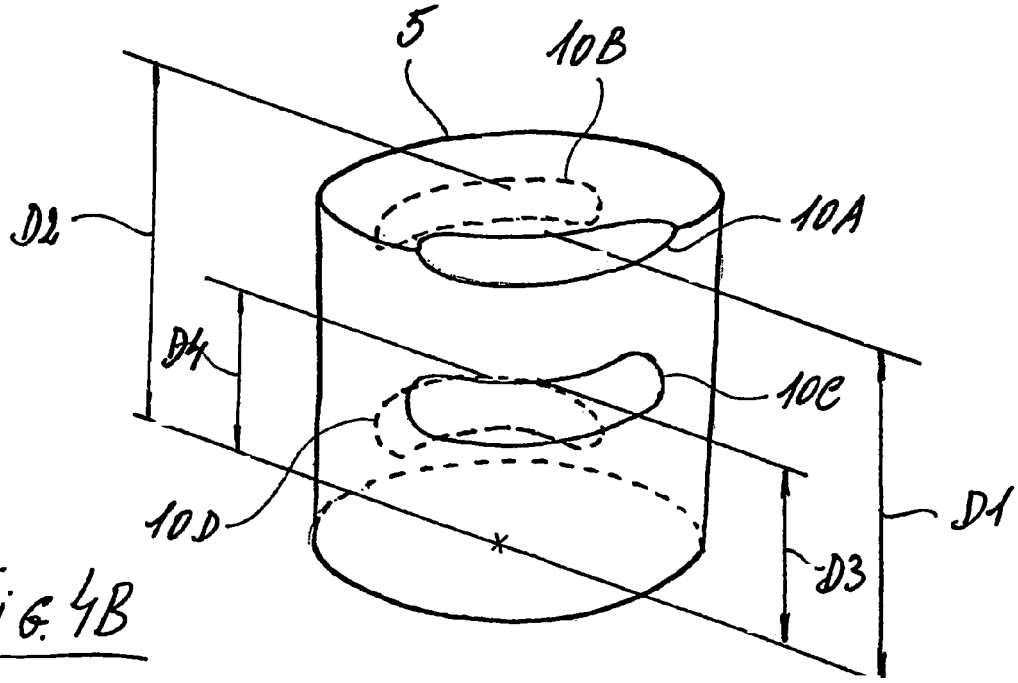
FIG. 4B shows schematically a perspective view of the buffer of the device of FIG. 2.

Still with the preferred example embodiment of FIGS. 4–5, the notched areas 10*a*, 10*b*, 10*c*, 10*d* of the buffer are aligned along two diametrically opposed groups on the buffer 5 and, ideally moving along the axis of the buffer 5, the notched areas 10*a*, 10*c* of a group are in staggered positions with respect to the notched areas 10*b*, 10*d* of the other group (FIGS. 4A, 4B—in FIG. 4B the height D1, with respect to a base of the cylindrical buffer 5, of the notch 10A is greater than the height D2 of the notch 10B on the opposite side, the height D2 is greater than the height D3 of the notch 10C and the height D3 is greater than the height D4 in relation to the notch 10D) of the notches; in this way the majority of the flux of cooling liquid which exits the through hole 6 into the meatus between the flat end 7 of the buffer and the flange 8, propagating radially towards the outside perimeter of the tubular sleeve 1 enters inside the bellows sleeve 1 and in correspondence with the notch 1O*a*, is divided into two streams which lap for 180° —one stream clockwise, the other anticlockwise—the surfaces of the buffer under the nervature 13*a*; the two streams reunite in correspondence with the notched area 10*b* which favours the passing of the stream from the nervature 13*a* to the nervature 13*b*; the cooling water is therefore divided into another two streams which lap the surfaces of the buffer 1 for 180° and merge in correspondence with the notched area 10*c* and so on, until the cooling liquid does not reach the nervature 13*d* of the bellows and leaves the bellows itself through a series of apertures 14 for example holes or buttonholes made in the flange 9 which closes the bellows sleeve 1 along the perimeter of the tubular sleeve 1, inside the sleeve itself; The cooling fluid is therefore collected in a circular collector 15 etched in the steel plate of the second support 3 and emptied through the discharge hole 16, made in the steel plate of the second support 3 and connected to the cooling circuit.

The general criteria with which the various notched areas 10*a*, 10*b*, 10*c*, 10*d* are located is that of creating a preferential passage, i.e. of minimal resistance, for the cooling fluid:

The first notched area 10*a* has the function of favouring the filling of the cavity inside the first nervature 13*a* of the bellows starting from a precise area of the perimeter of the nervature itself and of the buffer 5, instead of in a random and undifferentiated way along the whole perimeter of the nervature 13*a*.

In this way the cooling fluid laps all the surfaces of the buffer 5 in a more uniform manner, improving, and making more uniform, the cooling both of the bellows sleeve 1 and the buffer 5 itself: for example the applicant has ensured that the temperature of the buffer during working can be maintained below 40°–50°.

That allows the use of less expensive materials for the realisation both for the tubular sleeve 1 and the buffer 5.

In the example described, the tubular sleeve 1 is realised in an appropriate stainless steel.

The skilled man the art will know to select appropriately beyond the dimensions of the important project to obtain good cooling of the tubular sleeve 1, such as for example the diameter of the buffer 5, shape and dimensions of the undulations of the bellows sleeve 1, the heights of the notches 10, the radius of curvature of the troughs 11 of the various undulations of the bellows and the distance between each trough 11 from the related notch 10.

The bellows like articulated joint of the present example embodiment other than allowing the oscillations of the containment plate 47 allow the translation in a horizontal direction: in fact, by regulating the pressure of the cooling liquid which fills internally the tubular sleeve 1 with appropriate means of cooling, it is possible to axially dilate the bellows sleeve 1, distancing the two supports 2, 3 or varying the force with which the containment plates 47 press against the shoulders 40, 41 of the crystallising rollers.

Advantageously, the pressure of the cooling liquid can be measured for example through a load cell or with analogous means of measurement, and controlled by appropriate means of control of such pressure, for example regulatory valves for the pressure of the cooling liquid; in this way it is possible to control the pushing of the containment plates 47 on the crystallising rollers in a more precise, finely and reliable way, than for example by controlling the pushing of the containment plate 47 solely with the hydraulic cylinder which moves the command shaft 37.

Preferably, but not necessarily the tubular sleeve articulated joint 1 is located in correspondence with the result of the pressure distribution of the molten metal bath on the containment plates 47, so that such pressure distribution gives rise to a null moment on the plates 47; however, without leaving the ambit of the present invention, the tubular sleeve articulated joint 1 can be placed also in different positions, determined by criteria different than said general criteria.

Preferably, the oscillations of the first support 2 around the horizontal axis X are however limited to between an appropriate maximum admissible value selected with appropriate means of containment, for example end point stops and pivots: In the example embodiment of FIGS. 1–4 such means of containment of the oscillations around the above mentioned axis X are performed with the three small columns 160 which perform the mechanical stop against which the plate P2 of the first support 2 can rest, or with analogous means to realise mechanical collisions.

The limited rotations of horizontal pivoting of the containment plates 47, together with an appropriate sizing of the tubular sleeve 1 and of the buffer 5, allow the limiting of the perimeter clearance between the tubular sleeve and buffer 5 along the axis of the buffer, avoiding in particular that the tubular sleeve 1 at some point comes into contact with the buffer 5: in this way the flow of cooling fluid is maintained more uniformly inside the tubular sleeve 1.

The flexible tubular sleeve 1 allows the plate 47 to oscillate thus adapting to the geometric imperfections of the crystallising rollers without undesired translational movements in the direction normal to the axes A1, A2 of the crystallising rollers, nor torsional oscillations—i.e. rotations parallel to the command shaft 47- with respect to the end of the shaft 47 itself.

An articulated joint for lateral containment plates according to the present invention has the advantage of easily assisting to be cooled internally, for example with water or other cooling liquids; Furthermore, for example with respect to a spherical joint or a traditional type pivot does not require lubrication, allows for minimal hindrance, and consequently to simplify the oxidation protection system of the liquid bath, allows carrying the first support 2 also when the lateral containment plate 47 is not in contact with the flank of the casting rollers. Another important advantage deriving from the use of such an articulated joint is that of approaching the application point of the pushing force to the frictional surfaces between the refractory plate and the casting roller, minimising in such a manner the moment exercised by the result of the frictional force with respect to the centre of the tubular sleeve 1. I.e. allowing to have the vector of action of the result of the pressure of contact closer to the vector of action of the pushing force.

Clearly the devices previously described as non limiting examples is susceptible to numerous variations and modifications, without leaving the scope of the present invention for this: for example the tubular sleeve can have one or more nervatures 13*a* which turn screw like and extend from one end to the other of the sleeve, rather than have a plurality of circular nervatures 13*a*–13*d* separated between them and closed on themselves; in such a case the lateral walls of the buffer 5 can be free from notches 10*a*–10*d*.

The notched areas 10*a*, 10*b*, 10*c*, 10*d* when present can be located variably on the external surface of the buffer 5, for example gathered in two groups, each of which is found on one side of the buffer 5 opposite to the side on which is found the other group, and not necessarily aligned along two diametrically opposed rows.

It is additionally clear that in the scope of the present invention are included all the equivalent embodiments.

The invention claimed is:

1. A containment device for containment of melt between crystallizing rollers of a casting machine, wherein said crystallizing rollers are able to rotate around two substantially horizontal rotation axes, and are placed in positions such as to define between them a zone of minimal distance between the surfaces of said crystallising rollers and so to allow, in the space above said zone of minimal distance, the accumulation of a melt poured from a tundish or other means of distribution, each of the crystallizing rollers comprising one or more shoulder surfaces lying in a plane normal to the rotation axes of the crystallizing rollers, said containment device comprising, on each side of the crystallizing rollers a lateral containment plate able to fit tightly against at least part of each of said shoulder surfaces whereby it contains the melt, pressing means able to move the lateral containment plate so as to bring it close to and hold it tightly against the shoulder surfaces and remove the lateral containment plate from the shoulder surfaces:

wherein the lateral containment plate is fixed to the pressing means through an articulated joint, said articulated joint comprises a flexible connecting element able to sustain the lateral containment plate allowing a horizontal pivoting at least around a pivot axis horizontal and substantially normal to rotation axes;

wherein the flexible connecting element comprises a flexible tubular sleeve.

2. The containment device according to claim 1, wherein the tubular sleeve comprises one or more corrugated walls, like bellows, allowing the horizontal pivoting of the containment plate.

3. The containment device according to claim 2, wherein the tubular sleeve is connected to the pressing means and to the lateral containment plate whereby it supports the containment plate like a cantilever shelf.

4. The containment device according to claim 3, wherein the tubular sleeve is part of a passage for a cooling fluid for cooling the one or more corrugated walls.

5. The containment device according to claim 4, wherein it comprises an internal body placed inside the tubular sleeve, whereby it defines one or more internal spaces between the internal body and the corrugated walls, the spaces being part of said passage for a cooling fluid.

6. The containment device according to claim 5, wherein the internal body comprises a lateral surfaces of such dimensions that each point of the lateral surface is substantially at a distance, from the closest point of the corrugated walls, when the tubular sleeve is in undeformed conditions, not less than a predefined minimum distance and wherein the tubular sleeve comprises two or more circular ribs surrounding transversal sections of the tubular sleeve, and one or more grooves shape interposed between two of said circular ribs.

7. The containment device according to claim 6, wherein there are provided at least two ribs and the external surfaces of the internal body comprises one or more notched areas, each of which has a surface of shape and dimensions such that each point of it is found substantially at a distance, from the closest point of the internal walls of said undeformed flexible tubular sleeve, greater than said predetermined minimal distance, so as to assist the flow of said cooling fluid from a cavity below a first of said circular ribs to the cavity below a second of said circular ribs closer to the outlet of the cooling circuit.

8. The containment device according to claim 7, wherein a plurality of notched areas is placed to form two groups, wherein one group is on a side of the external surfaces opposite to the side on which another group is.

9. The device according to claim 7, wherein each of the notched areas have a substantially oblong shape and are located substantially parallel to the closest one of said one or more grooves.

10. The containment device according to claim 9, wherein each of the internal spaces between the tubular sleeve and the internal body is closed by a wall close to one end of the tubular sleeve, and wherein the walls have one or more apertures, located around the tubular sleeve allowing the flow of the refrigerant liquid from the tubular sleeve.

11. The containment device according to claim 10, wherein the internal body and the tubular sleeve have shape, dimensions and flexibility, that during functioning do not come into contact with each other, even under the effect of the weight of said lateral containment plate and the support onto which said plate is fixed.

12. The containment device according to claim 11, wherein it comprises means for measuring the pressure of the cooling fluid inside the internal space, and means for controlling the pressure of the cooling fluid.

13. The containment device according to claim 12, wherein it comprises one or more mechanical abutments which perform the mechanical stop against which the plate of the support can rest, and limit horizontal pivoting of the containment plate.

* * * * *